US006029625A

United States Patent [19]

Bischof et al.

[11] Patent Number: 6,029,625

[45] Date of Patent: Feb. 29, 2000

[54] METHOD AND ARRANGEMENT FOR CONTROLLING AN OPERATING VARIABLE OF A MOTOR VEHICLE

[75] Inventors: Hubert Bischof; Martin Streib, both of Vaihingen, Germany

[73] Assignee: Robert Bosch GmbH, Stuttgart, Germany

[21] Appl. No.: 09/150,601

[22] Filed: Sep. 10, 1998

[30] Foreign Application Priority Data

Sep. 11, 1997 [DE] Germany ..... 197 39 827

[51] Int. Cl.[7] ..... F02D 9/00; F02D 41/00

[52] U.S. Cl. ..... 123/399

[58] Field of Search ..... 123/399, 361, 123/396, 683, 696

[56] References Cited

U.S. PATENT DOCUMENTS 4,911,125 3/1990 Sugawara et al. ..... 123/399
4,982,710 1/1991 Ohta et al. ..... 123/399
5,062,404 11/1991 Scotson et al. ..... 123/399
5,144,915 9/1992 Grabs ..... 123/683

*Primary Examiner*—Andrew M. Dolinar
*Assistant Examiner*—Mahmoud M. Gimie
*Attorney, Agent, or Firm*—Walter Ottesen

[57] ABSTRACT

The invention is directed to a method and an arrangement for controlling an operating variable of a motor vehicle. A friction-burdened actuator assembly, which influences the operating variable, is actuated via a drive signal. This drive signal is formed on the basis of a desired value of the operating variable. The drive signal is additionally changed in response to a desired change of the operating variable to transfer the actuator assembly out of a steady state condition preferably so as to effect an actual change of the operating variable. In this way, the static friction of the actuator assembly, which is in opposition to the change of the operating variable, is overcome. Furthermore, the drive signal can be additionally changed in the sense of a reduction of the change of the operating variable when the operating variable approaches the desired value thereof.

12 Claims, 5 Drawing Sheets

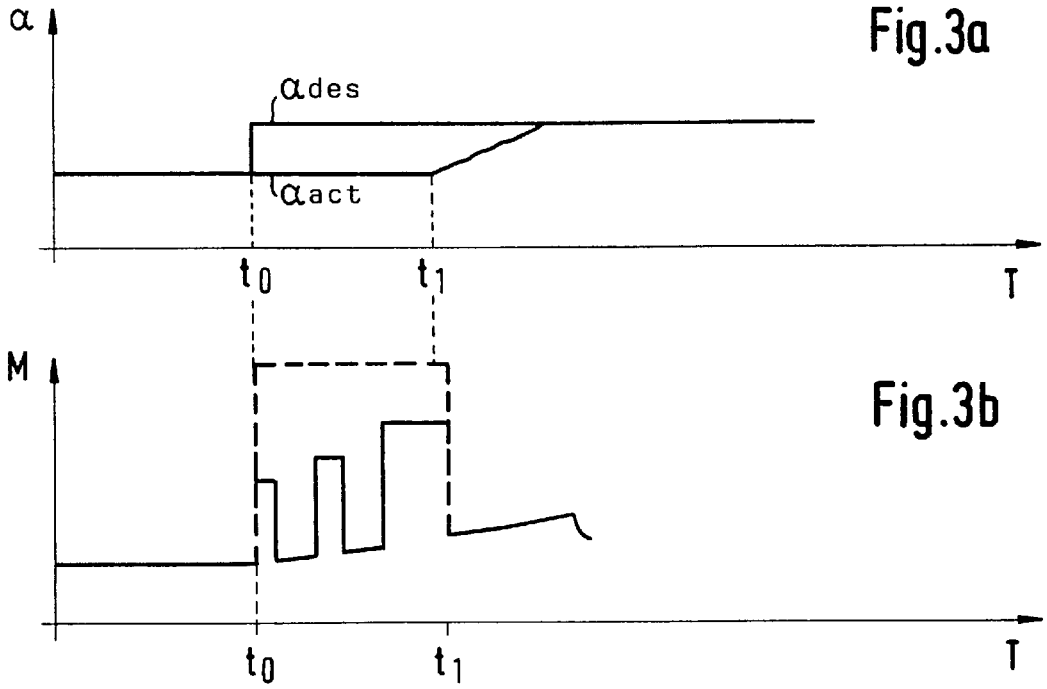
Fig.3a
Fig.3b
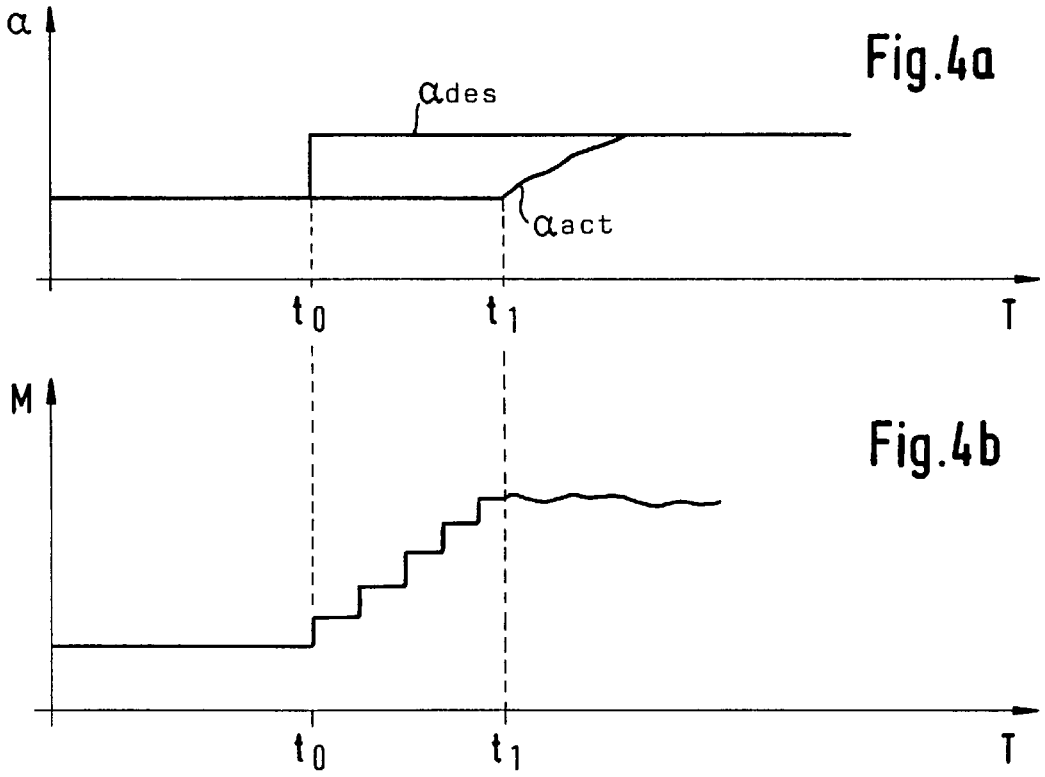
Fig.4a
Fig.4b

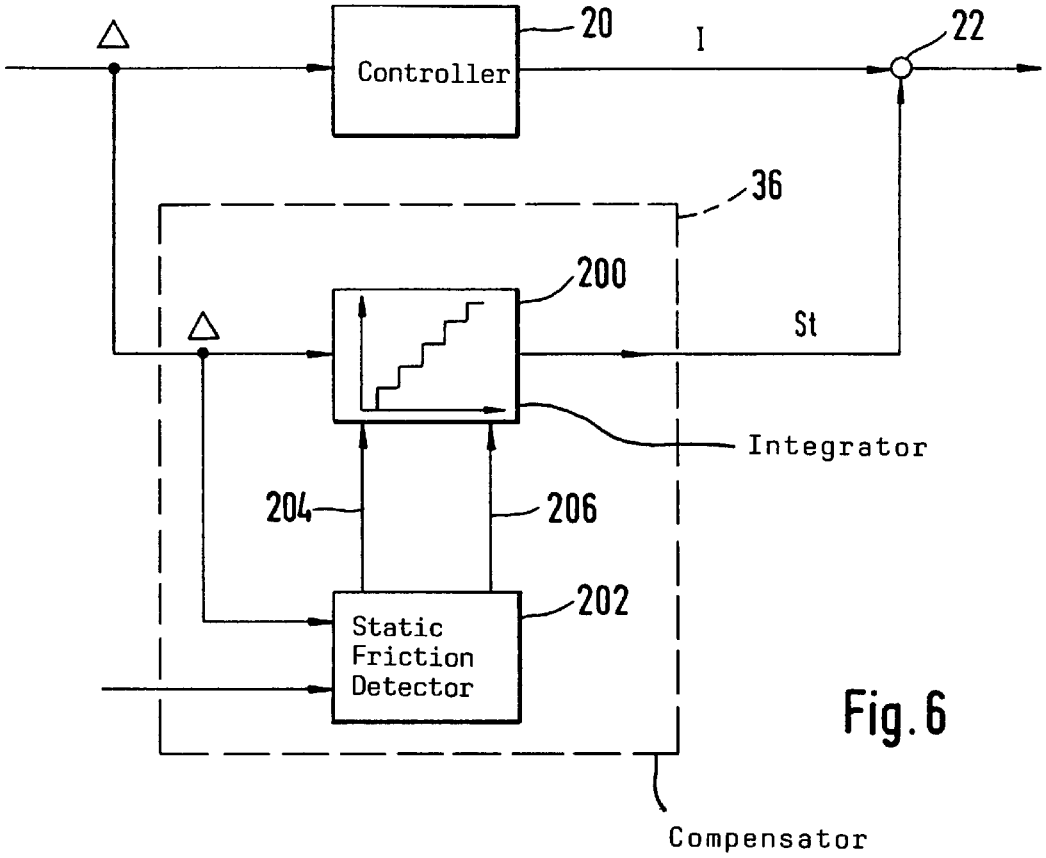
Fig. 6
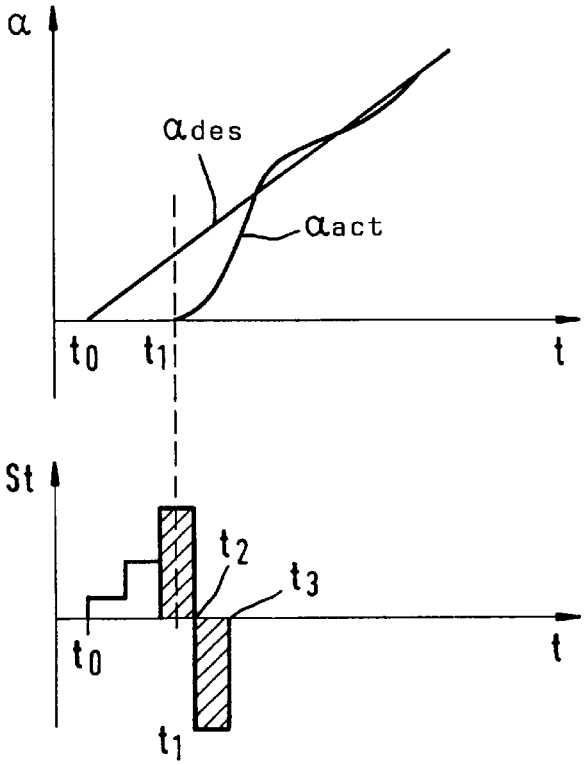
Fig. 7a
Fig. 7b

METHOD AND ARRANGEMENT FOR CONTROLLING AN OPERATING VARIABLE OF A MOTOR VEHICLE

BACKGROUND OF THE INVENTION

In the area of motor vehicle control, operating variables are adjusted via actuators subjected to friction. An example is the adjustment of a friction-burdened actuator, such as a throttle flap, in the context of the following: power control, rpm control or a drive-slip control. A corresponding control system is disclosed in U.S. Pat. No. 5,144,915. Difficulties in carrying out the control result from the friction which burdens actuators such as static friction. These difficulties are overcome by limiting the change of the speed of the control variable by intervening in at least one constant of the controller. Such a controller is, however, not suitable for all applications.

In general, the following problems occur in the control of an actuator subjected to friction.

If the system is in a steady state (actuator at standstill), then the drive of the actuator must develop a torque change when there is a change of state. This is necessary to overcome the static friction of the actuator. The torque generated by the drive must therefore be relatively large because, in the opposite case, the actuator does not immediately track the change because of the static friction. Especially for slight changes, the necessary torque change, which overcomes the static friction, takes place only after the elapse of a specific time when the time-dependent components of the controller (especially its I-component) have formed a corresponding control signal. This can lead to disadvantages in the control performance.

A further problem which occurs in addition to the first-mentioned problem or occurs independently therefrom, relates to the transient effect of the operating variable to the desired value. A high torque on the drive of the actuator imparts movement thereto. The static friction becomes sliding friction so that less torque is needed. The torque, which is built up to break loose the actuator from the static friction, can be so high that the actuator shoots beyond the desired position. An effect of this kind is unwanted with respect to the control performance and the driving comfort of the motor vehicle.

SUMMARY OF THE INVENTION

It is an object of the invention to provide measures which facilitate overcoming the static friction for an actuator burdened by friction and/or with the aid of which the target quantity of the controlled operating variable, which is controlled by the friction-burdened actuator, can be achieved without significant overshoots.

The method of the invention is for controlling an operating variable of a motor vehicle which includes an actuator assembly for influencing the operating variable. The actuator assembly is subjected to friction in a steady-state condition thereof which counters a change of the operating variable. The method includes the steps of: providing a desired value of the operating variable; forming a drive signal for actuating the actuator assembly on the basis of the desired value of the operating variable; and, additionally changing the drive signal in response to a desired change in the operating variable to transfer the actuator assembly out of the steady-state condition thereby overcoming the friction.

In the open-loop/closed-loop control of an operating variable of a motor vehicle, the static friction, which is inherent to the actuator which influences the operating variable, is overcome. In this way, a rapid change of the operating variable out of steady-state conditions is ensured. In the preferred embodiment, the standstill of the actuator is understood to mean steady-state conditions.

It is especially advantageous that this advantageous effect can also be achieved when there is a large scattering with respect to friction characteristics of specimens of the actuator.

It is especially advantageous that the static friction is overcome and the improved open-loop/closed-loop control performance is made possible without additional devices such as additional components, additional inputs into the control unit or special open-loop/closed-loop methods.

In an advantageous manner, a controller can be adjusted for the operating variables independently of the static friction effects of the actuator. The control operation itself is likewise independent of the static friction because the static friction is compensated. From this, the advantage results that the controller is especially robust with respect to changes in static friction.

In an advantageous manner, the overshoots of the actuator are effectively avoided or reduced when reaching the target magnitude of the operating variable.

The application for a bearing control of a throttle flap is especially advantageous for the control of rpm, et cetera (operating variable=position of the actuator).

BRIEF DESCRIPTION OF THE DRAWINGS

The invention will now be explained with reference to the drawings wherein:

FIG. 3*a* shows a plot of the actual value αact and the desired value αdes plotted as a function of time;

FIG. 3*b* shows the time-dependent trace of the torque M developed by the actuator;

FIG. 4*a* shows the time-dependent trace of the actual value αact and the desired value αdes for another embodiment or supplementary solution for influencing the integral component of the controller;

FIG. 4*b* shows the time-dependent trace of the torque M developed by the actuator;

FIG. 6 is a block circuit diagram of a second embodiment of the invention; and, FIGS. 7*a* and 7*b* show the operation of the embodiment of FIG. 6 with time-dependent traces of α and the control value St, respectively.

DESCRIPTION OF THE PREFERRED EMBODIMENTS OF THE INVENTION

Figure 1:
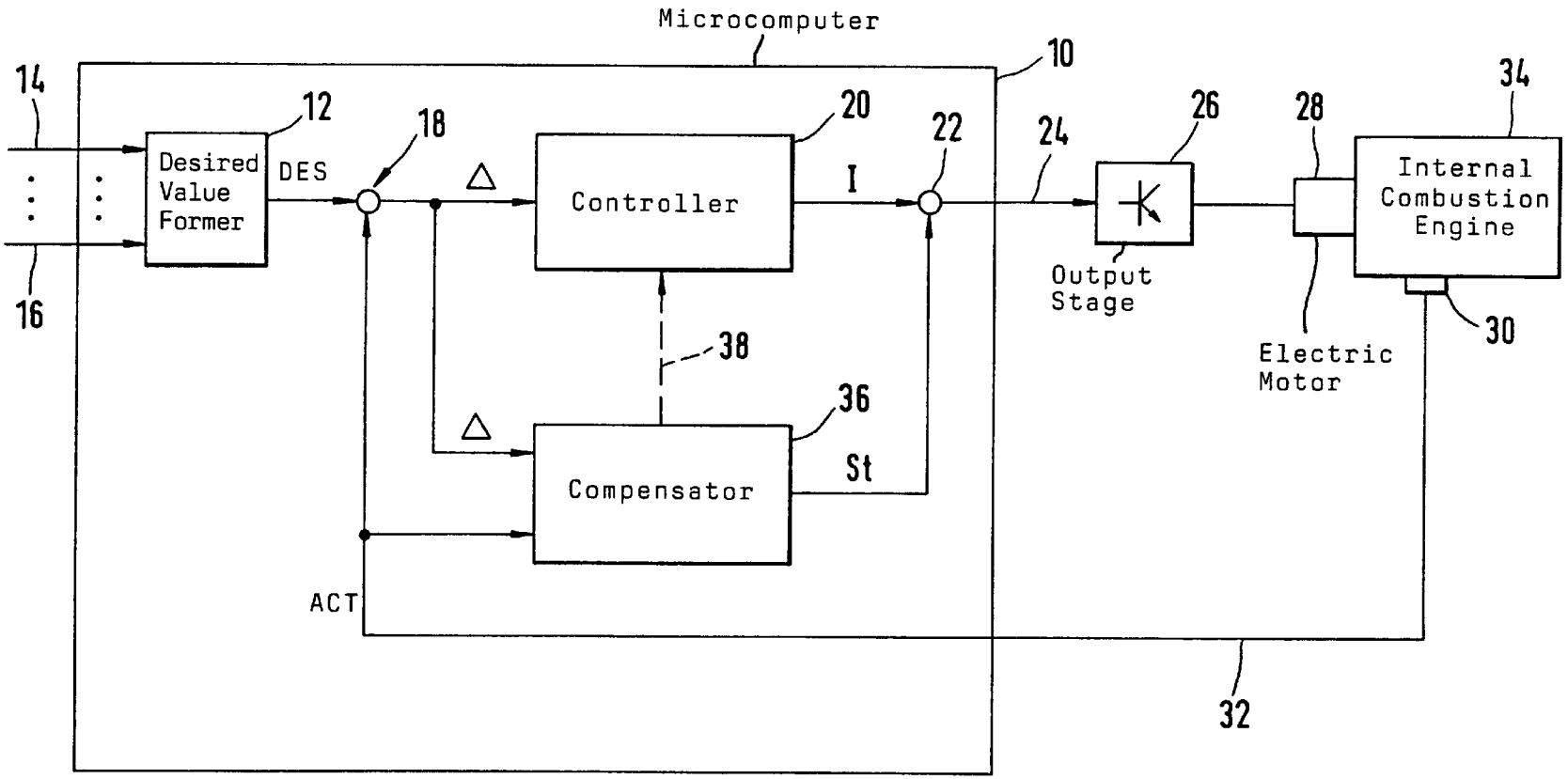
FIG. 1 shows a block circuit diagram of a control loop which controls the operating variable of a motor vehicle via a friction-burdened actuator and the control loop is provided with measures for compensating for the static friction.

FIG. 1 is a block diagram of a microcomputer 10 wherein, inter alia, a controller for controlling an operating variable of a motor vehicle is implemented. This controller is configured as a program of the microcomputer and is shown as a block circuit diagram. An example of such a controller is a position controller for adjusting the position of a throttle flap in dependence upon a desired value pregiven, for example, by the driver. Another example of such a controller is a rpm control loop via which the rpm of the drive unit of the motor vehicle is controlled in dependence upon pregiven desired values (such as an idle desired rpm) via control of an actuator influencing the air supply to the engine. Still another example of such a controller is an rpm control loop which controls the torque of the drive unit via at least one actuator. Still another example of such a controller is a load control loop.

In the microcomputer, a desired-value former 12 is implemented which forms a desired value for the operating variable to be controlled. The formation of the desired value is made in dependence upon operating variables of the motor vehicle or of its drive unit in accordance with predetermined characteristic lines, characteristic fields or tables. The operating variables are supplied via input lines 14 to 16. Examples of variables which can be applied for forming the desired value are the position of an operator-controlled element, the status of consumers, the engine temperature, etc cetera. The desired value DES is supplied to a comparator position 18 wherein the desired value DES is compared to the actual value ACT of the operating variable. The comparison result Δ is supplied to a controller 20 which has an integral component.

The integral component integrates the supplied comparator result (the control deviation Δ) and forms at least one output signal I in dependence upon this result. In the preferred embodiment, this output signal I is supplied to a logic element 22. The output line 24 of the microcomputer 10 leads from the logic element 22 to an output stage 26 which actuates an electric motor 28. The electric motor 28 and the positioning element (for example, a throttle flap) actuated by the electric motor conjointly define the actuator assembly burdened by friction. The throttle flap is not shown per se and is included as part of the drive unit 34 (for example, an internal combustion engine). The positioning element influences the operating variable to be controlled which is detected by a measuring device 30 and is supplied as an actual variable to the microcomputer 10 via the input line 32.

In the preferred embodiment of a position control loop, the measuring device 30 detects the position of the throttle flap of an internal combustion engine 34. In other advantageous embodiments, the rpm, the engine load, et cetera, are detected by the measuring device 30. A compensator 36 is provided in the microcomputer 10 to compensate the static friction effects and/or to prevent or reduce the overshoot when reaching the target magnitude of the operating variable. The control deviation Δ as well as the variable ACT are supplied to the compensator 36. The compensator 36 determines at least a control value St in dependence upon the input quantities. This control value St is applied to the controller output signal in the logic element 22 for overcoming the static friction and/or to prevent or reduce overshoot.

In another advantageous embodiment, at least one of the controller constants (especially the I component) is influenced in dependence upon the control signal St in the sense of overcoming the static friction and/or in the sense of reducing or avoiding overshoots. This is in lieu of or in addition to influencing the controller output signal and is via the line 38 shown as a broken line in FIG. 1.

The following embodiments are described with respect to the preferred embodiment of the position control of a throttle flap of an internal combustion engine. The procedure provided by the invention can be utilized everywhere where an operating variable is adjusted via an actuator assembly subjected to friction. Accordingly, in the following, the terms "desired position" and "actual position" are understood to be the desired value and actual value of the particular operating variable to be controlled.

In a first embodiment, the compensator 36 and the controller 20 operate as described below.

In the steady-state condition, the compensator 36 is activated for a throttle flap at standstill or a positioning element at standstill. This state is detected by evaluating the change of the actual value when the change of the actual value is below a predetermined limit value such as zero and/or the control deviation Δ lies below a predetermined limit value (especially zero) for a specific time. If the desired position then changes (that is, if there is a change of the control deviation Δ), a so-called start pulse is triggered by the compensator 36 (start signal St). The time duration and/or amplitude is selected so small that it only has an effect on the positioning element (that is, only then leads to a movement of the positioning element) when the friction of the positioning element lies at the lower scattering end of the specimens. The start pulse St leads via the logic element 22 directly to a charging of the actuator 28. The effect of this start pulse is checked with respect to the actual position of the positioning element. If the actual position changes, then the positioning element has moved and the start pulse has brought the desired effect. The further control then takes place in the context of the conventional control via the controller 20. If the positioning element has not moved notwithstanding the start pulse, then a second pulse is triggered whose time duration and/or amplitude is preferably greater than the first pulse. This is repeated with increasing pulses so long until the positioning element (throttle flap) is set into motion.

In lieu of the described pulse chain, a single start pulse of unspecified duration is first triggered in another advantageous embodiment. During the time that the pulse is applied, a check is continuously made as to whether the positioning element has moved. As soon as this is the case, the pulse is interrupted and further control of the positioning element takes place exclusively via the controller 20.

In both procedures, the controller 20 is also active during the start pulse(s) and forms an output signal I on the basis of the control deviation Δ. In addition to the start pulse, this output signal I contributes to the torque buildup at the actuator 28.

In a further advantageous embodiment, the integral component of the controller 20 is increased by a defined amount as an alternative to or in addition to the start pulse when there is a change of the desired position from the steady-state condition (that is, a positioning element at standstill). Here too, a check is made whether the positioning element has been set into motion. If this is not the case, then the integral component is further increased as in the case of the start pulse until the positioning element is in motion.

For avoiding or reducing the overshoot of the positioning element, a braking pulse is outputted by the compensator 36 and/or the integral component of the controller is set to any desired output or is set to zero when the target position is reached. In this way, a torque is applied to the positioning element which is opposite to the direction of movement of the positioning element. The brake pulse is triggered when the control deviation Δ drops below a predetermined limit value, that is, when the positioning element approaches its desired position.

Preferably, this limit value is itself a function of the speed of the positioning element, that is, a function of the time-dependent derivative of the actual position of the positioning element. The duration and/or the amplitude of the brake pulse is likewise preferably a function of the speed of the positioning element at the time point at which the brake pulse is triggered.

In a further advantageous embodiment, the pulse duration is subsequently corrected in that the pulse is lengthened so long until a complete braking of the positioning element takes place, that is, until the speed of the positioning element drops below a predetermined limit value such as zero.

Figure 2:
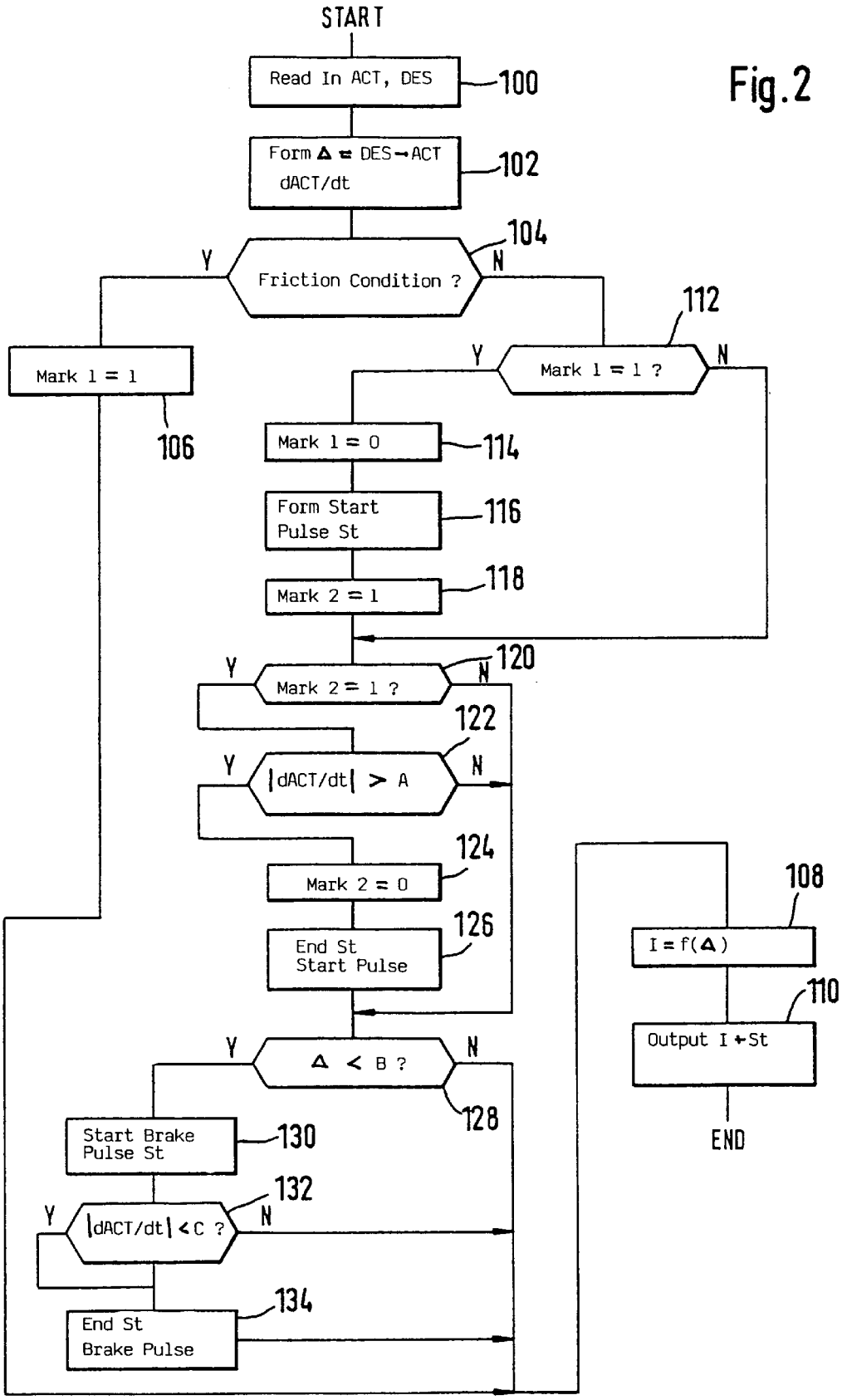
FIG. 2 shows an embodiment of a flowchart which shows the realization of measures for compensating static friction and/or for preventing overshoots with the realization of the measures being defined as a program of a microcomputer.

The preferred realization of the embodiment takes place as a program of the microcomputer 10. An example of such a program is represented by the flowchart of FIG. 2. The program shown in FIG. 2 is run through at pregiven time points.

In the first step 100, desired and actual quantities are read in. Thereupon, in step 102, the control deviation Δ is formed as difference between desired and actual quantities as well as the change of the actual quantity, for example, as time-dependent derivative dACT/dt. Thereupon, in inquiry step 104, a check is made as to whether the positioning element is at standstill, that is, whether a static friction condition is present. In the preferred embodiment, this takes place with respect to the control deviation Δ and/or the gradient of the actual value. If step 104 determines that the positioning element is at standstill, then a first mark is set to the value 1 (step 106). Thereupon, in step 108, the computation of the controller output signal I is made on the basis of the control deviation Δ. In the preferred embodiment, the controller has at least an integral component which generates the output signal I via integration of the control deviation. In the next step 110, the controller output signal I is outputted added to the control value St formed as described below. The program is ended and is run through at the next time point.

If in step 104 it was detected that the positioning element is moving, then the first mark is checked in step 112 as to whether it has the value 1. If this is the case, then this is an indication that the positioning element has just begun to move. In this case, the mark is set to 0 in step 114 and, according to step 116, the start pulse or the control signal St is formed with a predetermined amplitude. In the next step 118, a second mark is set to the value 1. After step 118, the step 120 follows as in the case of a negative answer in step 112. There, the second mark is checked as to the value 1. If the second mark has this value, a control signal St is active. For this reason, in step 112, the gradient of the actual value is compared to a limit value A. With this check, it is determined whether the positioning element is moving. If the positioning element moves (gradient greater than A), the mark 2 is set to the value 0 in accordance with step 124 and, in step 126, the control signal St is reset. If the mark 2 according to step 120 is 0 or if the positioning element does not move according to step 122, then the program is continued with step 128 which follows step 126.

In addition to the changing duration of the control signal St, in another embodiment, the signal amplitude is alternatively increased or supplementally increased and the program is broken off when a movement of the positioning element is detected. The steps 104 to 126 describe the control of the positioning element at the start of a desired value change in order to overcome the effective static friction. A solution is illustrated wherein the control signal St (start pulse) is unlimited (if required, only limited by a maximum time and/or a maximum amplitude) and is broken off for a detected movement of the positioning element. In a corresponding manner, the above-described further embodiments (formation of a pulse chain having several start pulses which increase and/or the influencing of the integrator of the controller) are realized as a program.

In step 128, a check is made as to whether the control deviation is less than a predetermined limit value B, that is, whether the positioning element is in close proximity of its target position. If this is the case, then, according to step 130, the control signal St is formed as a brake pulse. In the next step 132, a check is made as to whether the gradient of the positioning element position has dropped below a limit value C, that is, whether the positioning element is in the vicinity of its standstill. If this is the case, then according to step 134, the control signal St is cut off and, as in the case of negative answers in steps 128 and 132, the program is continued with step 108.

The effect of the procedure described above is shown in the time diagrams presented in FIGS. 3*a* to 5*b*.

With respect to the example of a position control loop for a throttle flap, FIG. 3*a* shows the time-dependent trace of the desired value αdes and the actual value αact; whereas, FIG. 3*b* shows the time-dependent trace of the torque M applied by the actuator. At first, the system is in the steady-state condition (that is, it is at standstill). The actual value corresponds to the desired value. At time point $t_0$, the desired value αdes increases abruptly. Starting at time point $t_0$, this leads to a control deviation which is integrated by the integral component of the controller and is transmitted further by the proportional component. The controller generates an output signal which corresponds to the integrated value (see the increasing base torque in FIG. 3*b*). The positioning element does not move because of the static friction. Up to time point $t_1$, the actual value remains constant. Only starting at this time point, the positioning element moves and the actual value approximates the desired value.

The effect of several start pulses of pregiven duration and amplitude on the torque of the positioning element is shown in FIG. 3*b* (solid line). A single pulse of unlimited duration is shown by a broken line. This pulse leads to an increase of the torque up to time point $t_1$ whereat the positioning element moves.

In FIGS. 4*a* and 4*b*, the solution of influencing the integral component of the controller is shown. This solution is an alternative to the formation of the control signal or is supplementary thereto. In FIG. 4*a*, the time-dependent trace of the desired value αdes and the actual value αact are shown; whereas, in FIG. 4*b*, the time-dependent trace of the torque M, which is developed by the positioning element, is shown. Up to time point $t_0$, the system is at standstill. At time point $t_0$, the desired value changes so that a control deviation Δ occurs which is controlled out by the controller. The positioning element at first does not move because of the effects of static friction. Only at time point $t_1$ is the static friction overcome and the actual value approaches the desired value. Between the time points $t_0$ and $t_1$, the torque of the positioning element is increased stepwise by adding a fixed value or a changing addition value to the integral value of the controller. At time point $t_1$, a movement of the positioning element is detected and the control is continued in a conventional manner.

Figure 5A:
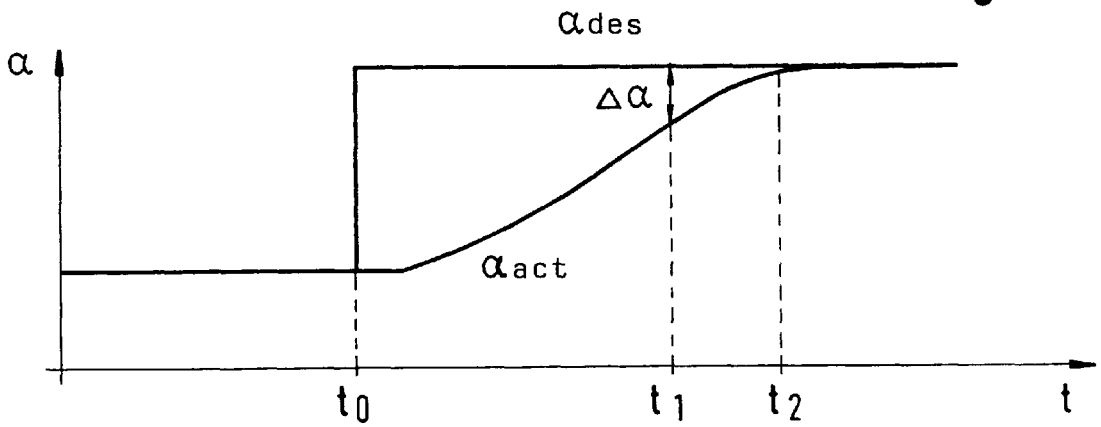
FIG. 5*a* shows the time-dependent trace of the actual value αact and the desired value αdes for another embodiment of the invention.
Figure 5B:
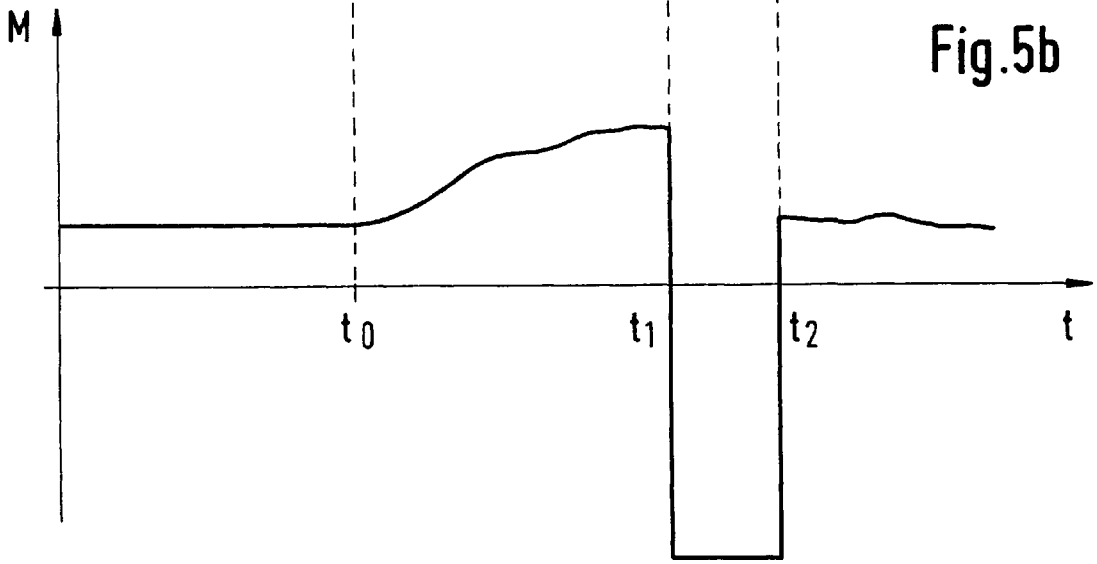
FIG. 5*b* shows the time-dependent trace of the torque M developed by the actuator for the values of α presented in FIG. 5*a;*

FIGS. 5*a* and 5*b* show the operation of the procedure of the invention when the positioning element reaches the target position.

In FIG. 5*a*, the time-dependent trace of the desired value αdes and of the actual value αact is shown; whereas, in FIG. 5*b*, the time-dependent trace of the torque M, which is applied by the positioning element, is shown. Here too, it is assumed that the positioning element is at standstill. At time point $t_0$, the desired value changes. This leads to a control intervention and, at time point $t_1$, the actual value comes close to the desired value so that an incremental value Δα remains. This value Δα is dependent preferably on the gradient of the actual value, that is, on the speed of the positioning element. This value $\Delta_\alpha$ serves to trigger a brake pulse which triggers a torque starting at time point $t_1$, which is opposite to the actual movement. This brake pulse is active as long as the speed of the positioning element (throttle flap) has not dropped below a specific value. This is the case at time point $t_2$ whereat the actual value swings or oscillates toward the desired value. At time point $t_2$, the brake pulse is withdrawn and the normal control continued. Insofar as the controller has an integral component, the integral component can be reset to a defined value with the triggering of the brake pulse.

A second embodiment is shown in FIGS. 6 and 7.

FIG. 6 shows a block circuit diagram wherein the compensator 36 according to the second embodiment is shown in greater detail.

The compensator includes an integrator 200 and a static-friction detector 202. The static-friction detector 202 is supplied with the actual value and the control deviation Δ. The integrator 200 is supplied only with the control deviation Δ. The state of the integrator 200 defines the control signal St which is applied in the logic element 22 to the control output signal I or directly to the integral value of the controller. To start and stop the integrator 200, two lines 204 and 206 are provided between the integrator 200 and the static-friction detector 202. The static-friction detector recognizes whether the actuator is subjected to static friction or not in dependence upon the control difference and/or the actual value. This is the case when the control difference is essentially 0 and/or the actual value does not change. If the condition of static friction is present, then the integrator 200 is activated via line 204. The integrator 200 integrates the present control deviation in dependence upon an integration constant from scan interval to scan interval until the static-friction detector 202 detects for the first time that static friction no longer is present. This is the case when the positioning element moves. In this case, the static-friction detector 202 stops the integrator 200 via line 206 and resets the same.

Since it is unknown when the system has broken loose since the last scan time point, an indeterminant quantity of additional energy was introduced into the system than would have been necessary for overcoming the static friction. This additional quantity is less or equal to the energy which was imparted to the positioning element since the last scan time point. After detecting the breaking loose of the positioning element (that is, after detecting the state of "no static friction"), the integrator is set to a negative value for the duration of a single scan interval via the stop signal on the line 206. The negative value corresponds to the amount of the maximum excess energy in the system. Thereafter, the integrator is reset to the value 0.

The negative value of the integrator leads to the condition that the system again withdraws the amount of maximum excess energy. Overshoots of the positioning element when reaching the target position are therefore not a problem because of high integrator values. During this phase, the parallelly operating controller 20 likewise operates in a manner for increasing torque. For this reason, the reset of the integrator 200 to the negative value does not lead to a renewed standstill with static friction. In other advantageous embodiments, when a high sliding friction occurs, for example, in addition to the static friction, the compensation value must be reset to a robust negative value of low amount in order to avoid a standstill of the positioning element.

After a stop via the line 206, the integrator 200 is again activated via line 204 when a renewed friction of the positioning element is recognized by the static-friction detector 202.

The operation of the second embodiment of the invention is shown in FIGS. 7*a* and 7*b*.

FIG. 7*a* shows the time-dependent trace of the desired value αdes and the actual value αact; whereas, FIG. 7*b* shows the time-dependent trace of the control value St.

The desired value is shown linearly and changes starting at time point $t_0$. Before the time point $t_0$, the system is in the steady-state condition, that is, the actuator is at standstill. For this reason, starting at time point $t_0$, the integrator integrates the occurring control deviation between the desired and actual values. At time point $t_1$, the positioning element breaks loose and the actual value approaches the desired value. This means that, at time point $t_2$, the integrator value becomes negative and the integrator is reset at the next scan time point $t_3$. In this way, a smooth approach of the actual value to the desired value is attained after breaking loose at time point $t_1$ without the occurrence of a significant overshoot or a renewed standstill of the positioning element.

In addition to the application of the solution of the invention for positioning elements burdened with static friction in the context of a control loop, a corresponding solution is also used with the advantages presented above for open control chains which adjust an operating variable of a motor vehicle via a positioning element subjected to static friction.

A steady-state condition of the positioning element is then present when static-friction effects become effective in the region of the positioning element especially when the positioning element is at standstill.

It is understood that the foregoing description is that of the preferred embodiments of the invention and that various changes and modifications may be made thereto without departing from the spirit and scope of the invention as defined in the appended claims.

What is claimed is:

1. An arrangement for controlling an operating variable of a motor vehicle, the arrangement comprising:

an actuator assembly for influencing said operating variable and said actuator assembly being subjected to friction in a standstill condition thereof;

a control apparatus for controlling said actuator assembly, said control apparatus including: means for presetting a desired value (DES) of said operating variable; and, a controller for forming and outputting a first control signal (I) for actuating said actuator assembly on the basis of said desired value (DES) of said operating variable;

means for detecting the actual value (ACT) of said operating variable; and, said control apparatus further including:

compensation means for forming and outputting a second control signal (ST) corresponding to the direction of movement of said actuator assembly out of said standstill condition;

means for changing said first control signal (I) with said second control signal (ST) to form a changed control signal (I, ST) at a time when said actuator assembly is to be moved out of said standstill condition to thereby overcome said friction;

said compensator means including means for monitoring said actual value (ACT) for changes therein indicating a movement of said actuator assembly; and, means for continuing the application of said changed control signal (I, ST) to said actuator assembly until said movement of said actuator assembly is determined on the basis of said actual value (ACT) of said operating variable.

2. The arrangement of claim 1, wherein said first control signal is additionally changed so as to cause said actuator assembly to effect an actual change of said operating variable.

3. An arrangement for controlling an operating variable of a motor vehicle, the arrangement comprising:

an actuator assembly for influencing said operating variable and said actuator assembly being subjected to friction;

a control apparatus for controlling said operating variable, said control apparatus including:

means for presetting a desired value (DES) of said operating variable;

a controller for forming and outputting a first control signal (I) for actuating said actuator assembly on the basis of said desired value (DES) of said operating variable so as to chance said actual value (ACT) of said operating variable to approach said desired value (DES) thereof thereby causing said actuator assembly to move toward a target position;

compensation means for determining whether said actual value (ACT) approaches said desired value (DES); and, said compensation means including means for forming and outputting a second control signal (ST) in the sense of braking said actuator assembly when said actual value (ACT) approaches said desired value (DES); and, means for changing said first control signal (I) with said second control signal (ST) to form a changed control signal (I, ST) to brake said actuator assembly thereby preventing or reducing an overshoot of said actuator assembly when reaching said target position thereof.

4. A method for controlling an operating variable of a motor vehicle which includes an actuator assembly for influencing said operating variable and said actuator assembly being subjected to friction in a standstill condition thereof, the method comprising the steps of:

presetting a desired value (DES) of said operating variable;

forming and outputting a first control signal (I) for actuating said actuator assembly on the basis of said desired value (DES) of said operating variable;

detecting the actual value (ACT) of said operating variable;

forming and outputting a second control signal (ST) corresponding to the direction of movement of said actuator assembly from said standstill condition;

changing said first control signal (I) with said second control signal (ST) to form a chanced control signal (I, ST) at a time when said actuator assembly is to be moved out of said standstill condition to thereby overcome said friction;

monitoring said actual value (ACT) for chances therein indicating a movement of actuator assembly; and, continuing the application of said changed control signal (I, ST) to said actuator assembly until said movement of said actuator assembly is determined on the basis of said actual value (ACT) of said operating variable.

5. The method of claim 4, comprising additionally changing said first control signal so as to cause said actuator assembly to effect an actual change of said operating variable.

6. The method of claim 4, comprising the further step of detecting said standstill condition when said actuator assembly does not move or when said operating variable does not change.

7. The method of claim 4, comprising the further step of adjusting said actuator assembly in the context of a control loop in dependence upon desired and actual values with said standstill condition being present when the control deviation is essentially zero.

8. The method of claim 7, comprising the further step of forming said second control signal in dependence upon said control deviation; and, stopping the formation of said changed control signal when movement of said actuator assembly is detected.

9. The method of claim 4, wherein said second control signal introduces additional energy into said control loop; and, said method comprises the further step of outputting a value of said second control signal when the formation of said second control signal is stopped and said value of said second control signal essentially compensating said additional energy.

10. The method of claim 8, comprising the further step of generating said second control signal when said actuator assembly is to be moved out of the standstill state thereof and interrupting said second control signal when a movement of said actuator assembly is detected.

11. The method of claim 8, wherein said second control signal is one of the following: a sequence of pulses having preferably increasing duration; a pulse of indefinite duration which is interrupted when there is a movement of said actuator assembly; the output signal of an integrator; or, an addition value to be added to an integrator of a controller for the operating variable.

12. A method for controlling an operating variable of a motor vehicle which includes an actuator assembly for influencing said operating variable and said actuator assembly being subjected to friction, the method comprising the steps of:

presetting a desired value (DES) of said operating variable;

detecting an actual value (ACT) of said operating variable;

forming a first control signal (I) for actuating said actuator assembly on the basis of said desired value (DES) of said operating variable so as to change said actual value (ACT) of said operating variable to approach said desired value (DES) thereof thereby causing said actuator assembly to move toward a target position;

determining whether said actual value (ACT) approaches said desired value (DES);

forming and outputting a second control signal (ST) in the sense of braking said actuator assembly when said actual value (ACT) approaches said desired value (DES); and, changing said first control signal (I) with said second control signal (ST) to form a chanced control signal (I, ST) to brake said actuator assembly thereby preventing or reducing an overshoot of said actuator assembly when reaching said target position thereof.

* * * * *

UNITED STATES PATENT AND TRADEMARK OFFICE

CERTIFICATE OF CORRECTION

PATENT NO. : 6,029,625
DATED : February 29, 2000
INVENTOR(S) : Hubert Bischof and Martin Streib It is certified that error appears in the above-identified patent and that said Letters Patent is hereby corrected as shown below:

Column 7,
Line 11, delete "$\Delta_\alpha$" and substitute -- $\Delta\alpha$ -- therefor.

Column 9,
Line 29, delete "chance" and substitute -- change -- therefor.
Line 59, delete "chanced" and substitute -- changed -- therefor.
Line 64, delete "chances" and substitute -- changes -- therefor.

Column 10,
Line 62, delete "chanced" and substitute -- changed -- therefor.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*